US006588130B1

(12) United States Patent
Yang

(10) Patent No.: US 6,588,130 B1
(45) Date of Patent: Jul. 8, 2003

(54) MUSIC BELL STRIKING SNOWFLAKES IN A CRYSTAL BALL

(76) Inventor: Shin-Ya Yang, 4F1., No. 1, Alley 8, Lane 45, Bao Hsin Rd., Hsin Tien City, Taipei Hsien (TW)

( * ) Notice: Subject to any disclaimer, the term of this patent is extended or adjusted under 35 U.S.C. 154(b) by 0 days.

(21) Appl. No.: 10/098,095

(22) Filed: Mar. 12, 2002

(51) Int. Cl.[7] ..... G09F 19/00
(52) U.S. Cl. ..... 40/410; 40/426; 40/406
(58) Field of Search ..... 40/426, 406, 409, 40/410, 411

(56) References Cited

U.S. PATENT DOCUMENTS 4,852,283 A * 8/1989 Teng ..... 40/426
5,743,780 A * 4/1998 Liu ..... 40/406

* cited by examiner

*Primary Examiner*—Cassandra H. Davis
(74) *Attorney, Agent, or Firm*—Pro-Techtor International Services

(57) ABSTRACT

A music bell striking snowflakes in a crystal ball includes an upper rotary mechanism, a lower rotary mechanism and a crystal ball. The music bell rotates not only a gear ring tray of the lower rotary mechanism on the bottom portion and a doll disposed on a rotary tray of the upper rotary mechanism, but also a magnet gear inside the crystal ball to cause water flow therein according to the principle of magnetic repulsion, so as to create a beautiful and dynamic scene of floating snowflakes.

1 Claim, 6 Drawing Sheets

MUSIC BELL STRIKING SNOWFLAKES IN A CRYSTAL BALL

BACKGROUND OF THE INVENTION

1) Field of the Invention

The present invention relates to a music bell striking snowflakes in a crystal ball, more especially to a music bell capable of rotating upwards and downwards to cause the snowflakes inside the crystal ball float according to the principle of magnetic repulsion and to drive the water flow to rotate so as to form a multiple sets of dynamic scenery.

2) Description of the Prior Art

Accordingly, when a spiral power spring on the bottom portion of a conventional music bell is wound, the gear set drives a doll or a crystal ball disposed at the upper aspect to rotate and send out music bell sound; however, this kind of conventional music bell is capable of driving a doll to rotate only toward a mono-direction but not upwardly and downwardly at the same time; without desired variations, the monotonous design makes the product less competitive and need improvement.

SUMMARY OF THE INVENTION

The primary feature of the present invention is to provide a music bell striking snowflakes in a crystal ball by utilizing an upper and a lower rotary mechanisms capable of synchronously driving the music bell to rotate toward different directions as well as utilizing the magnetic repulsion principle of a magnet gear and a magnet wheel inside the upper and lower rotary mechanisms to drive a magnet gear inside the crystal ball to rotate the water flow so as to make snowflakes in the crystal ball float and thus create a beautiful and dynamic scenery.

To enable a further understanding of the structural features and the technical contents of the present invention, the brief description of the drawings below is followed by the detailed description of the preferred embodiment.

DETAILED DESCRIPTION OF THE PREFERRED EMBODIMENTS

Figure 6:
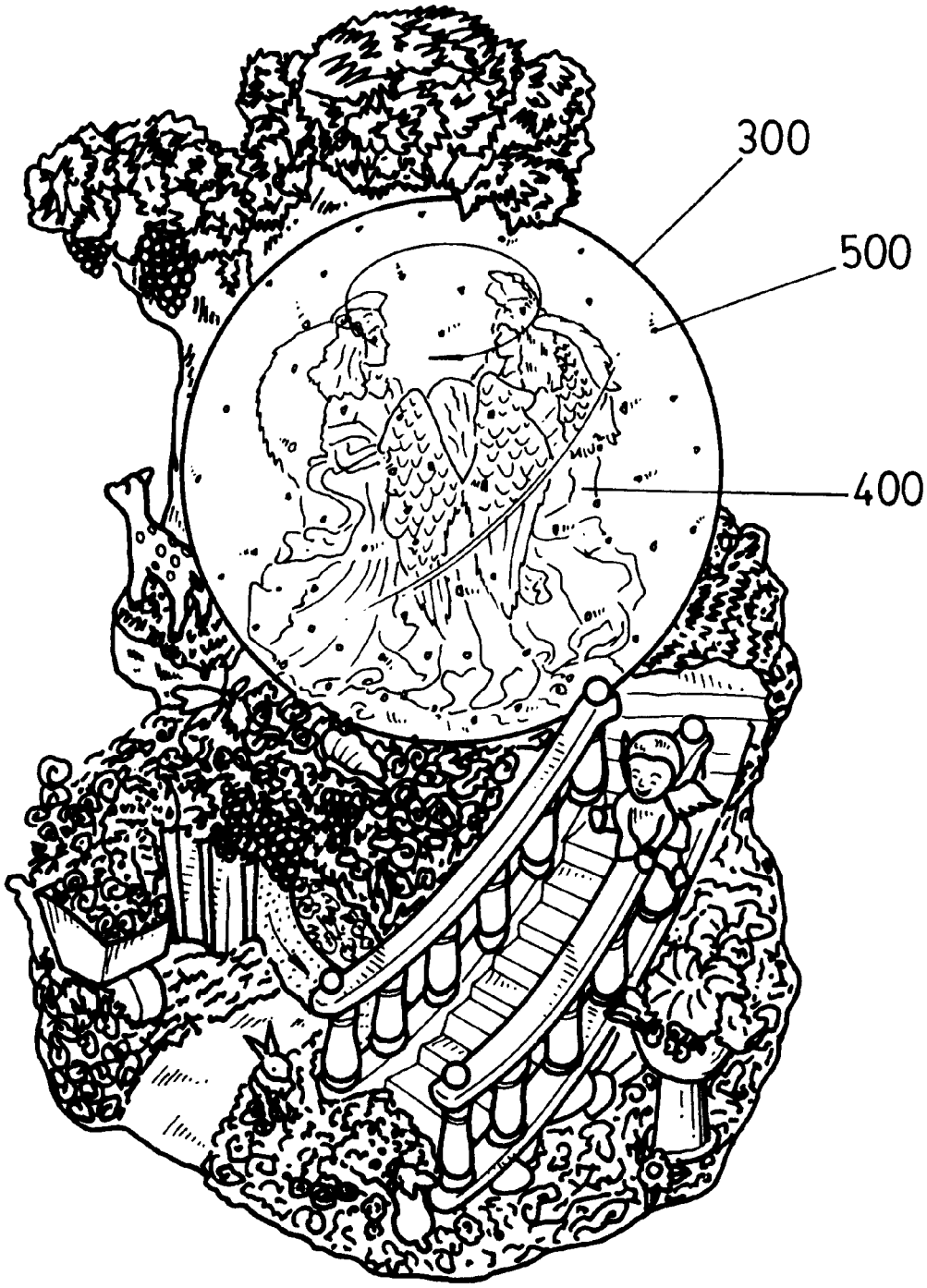
FIG. 6 is a drawing of an exemplary embodiment of the present invention.

Referring to all of the Figures, the present invention mainly comprises of a lower rotary mechanism (100), an upper rotary mechanism (200) and a crystal ball (300); wherein the crystal ball (300) is disposed with a doll (400) and filled with the water, as shown in FIG. 6; countless snowflakes (500) (glittering flakes) are filled inside the water.

Figure 1:
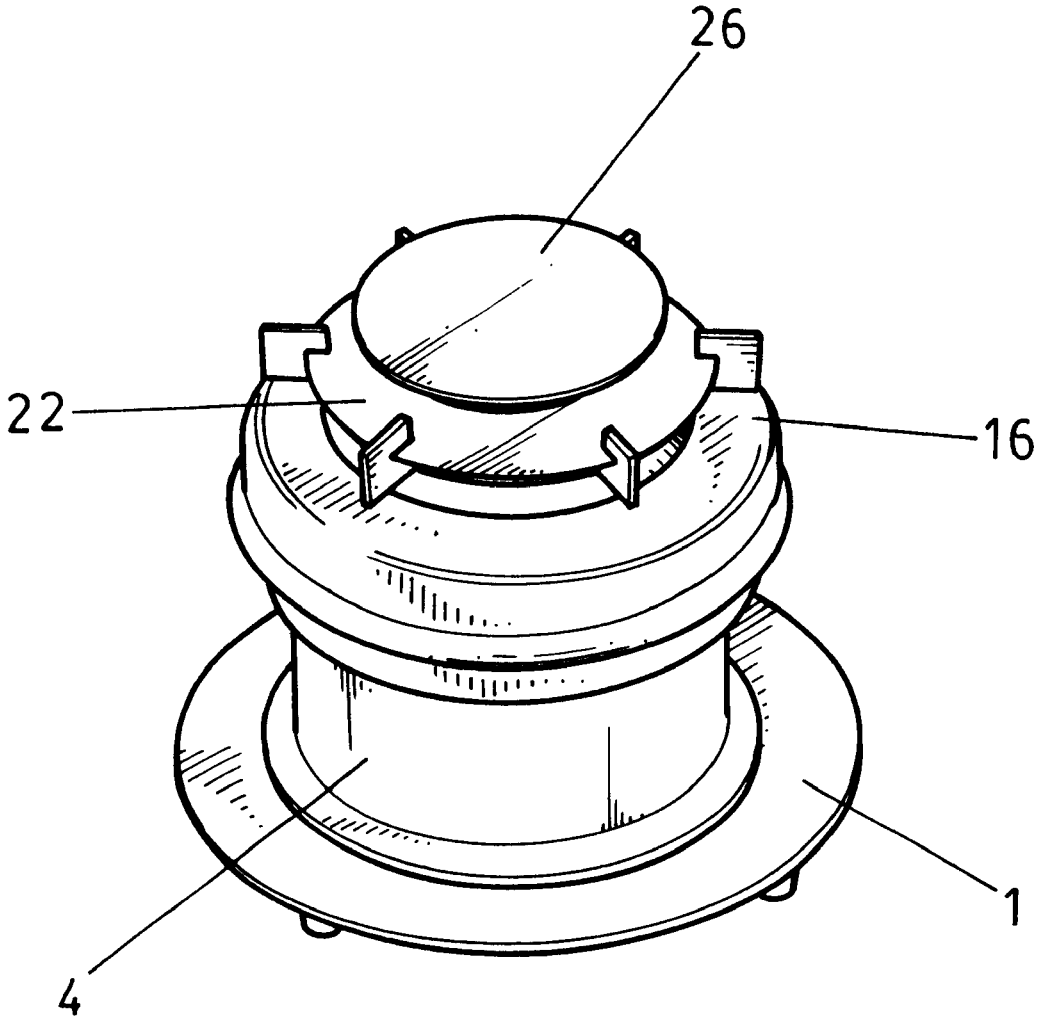
FIG. 1 is an external drawing of the assembly of an upper and lower rotary mechanisms of the present invention.
Figure 2:
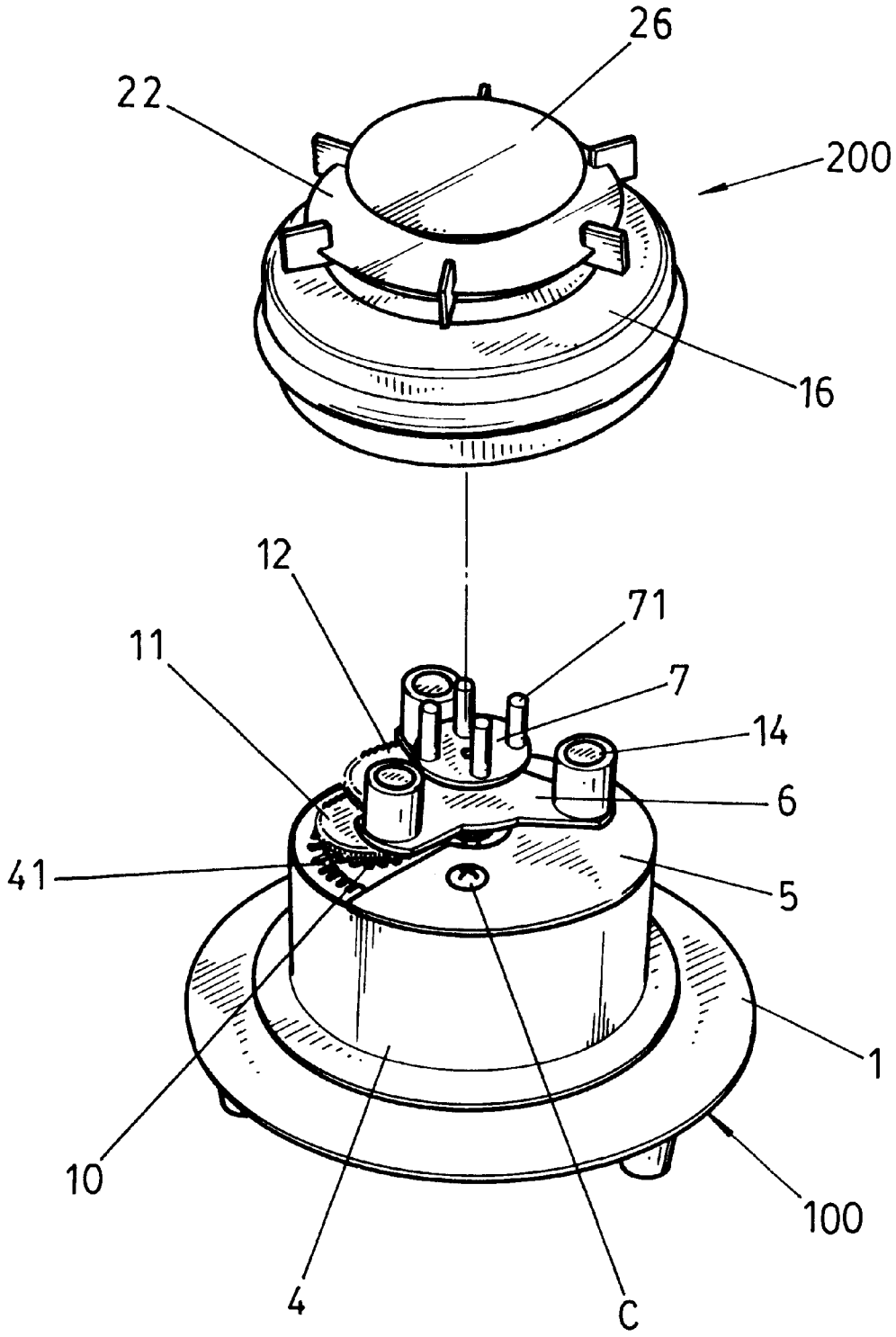
FIG. 2 is an exploded drawing of the upper and lower rotary mechanisms of the present invention.
Figure 3:
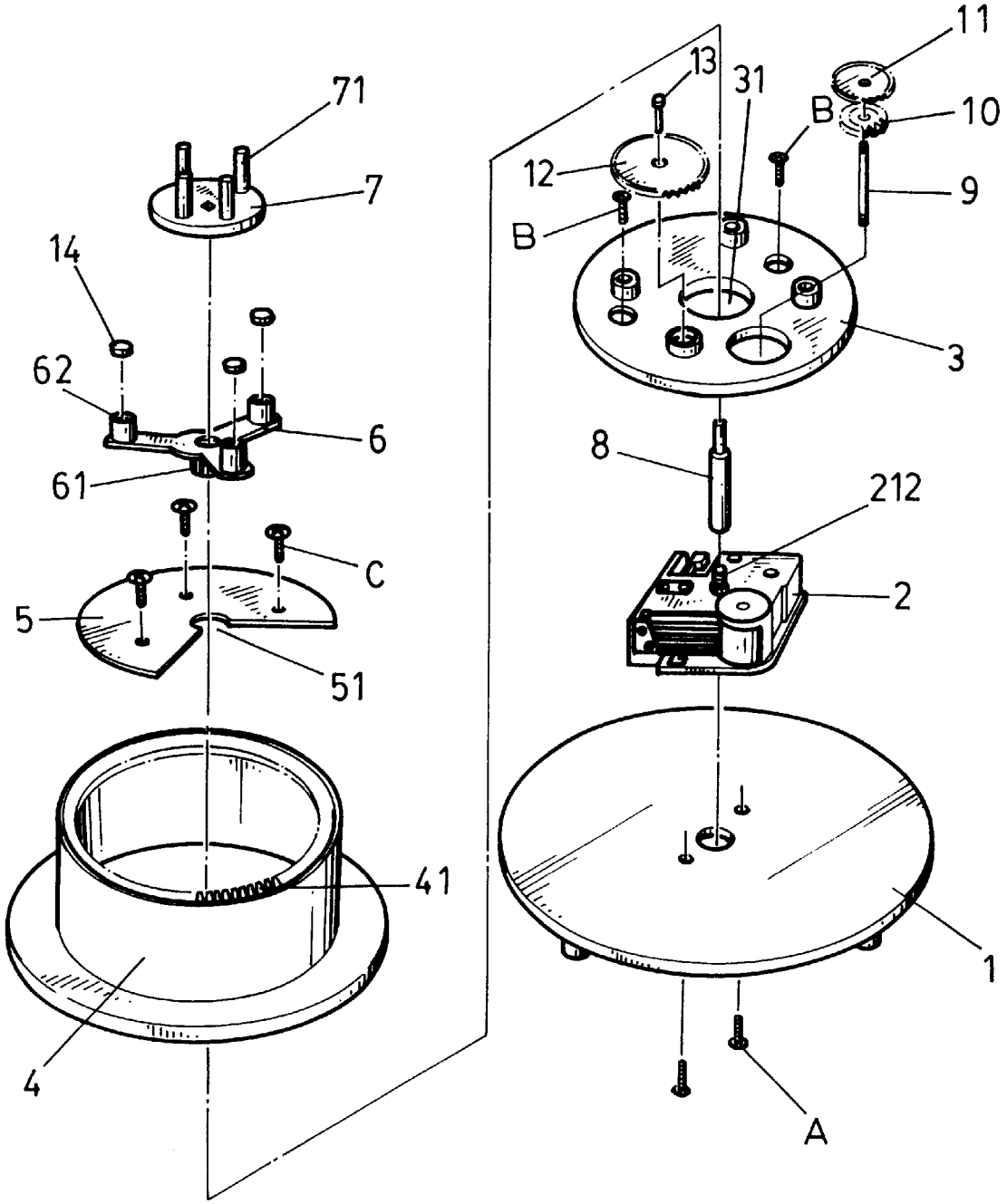
FIG. 3 is an exploded drawing of the lower rotary mechanisms of the present invention.
Figure 4:
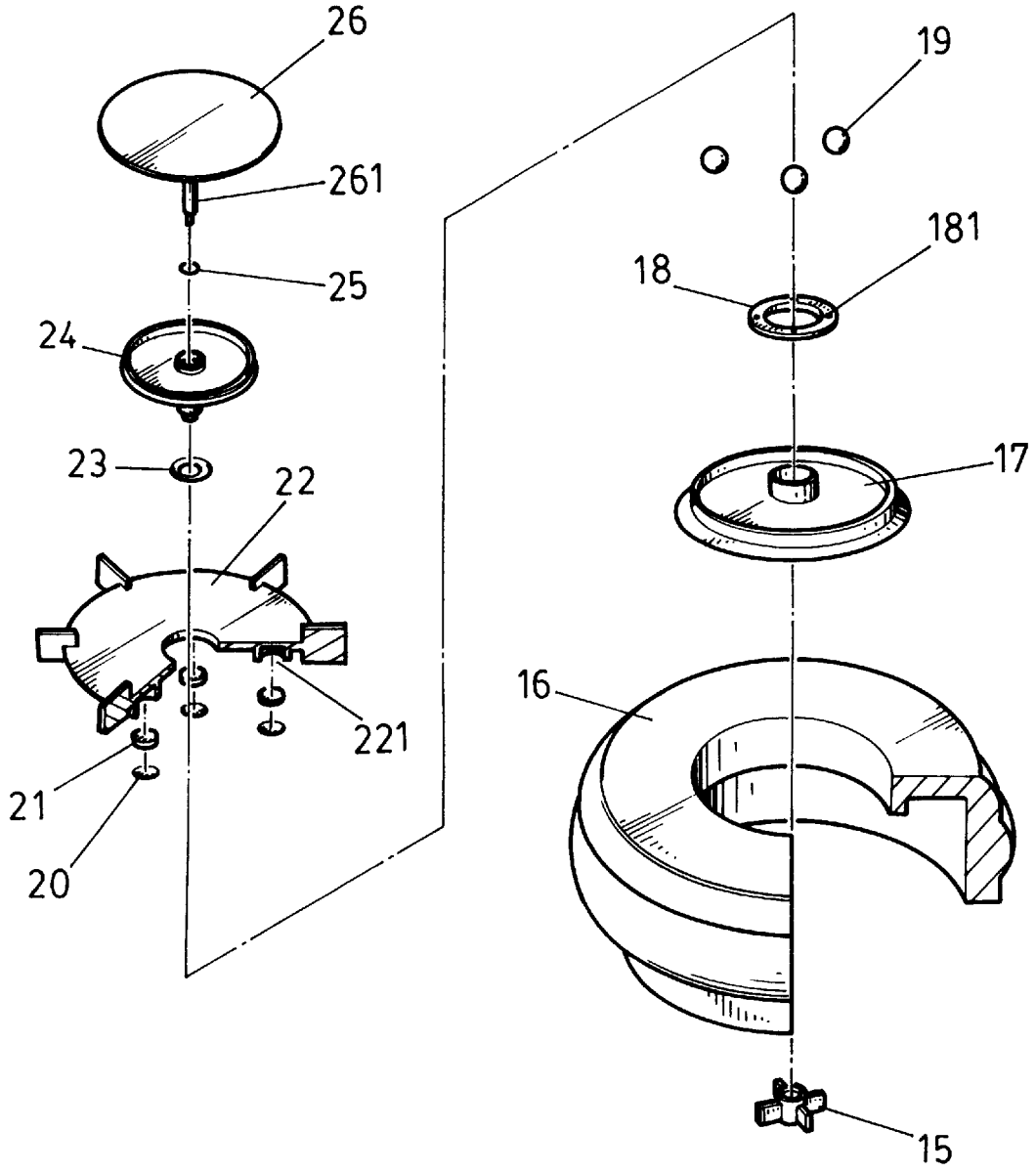
FIG. 4 is an exploded drawing of the upper rotary mechanisms of the present invention.
Figure 5:
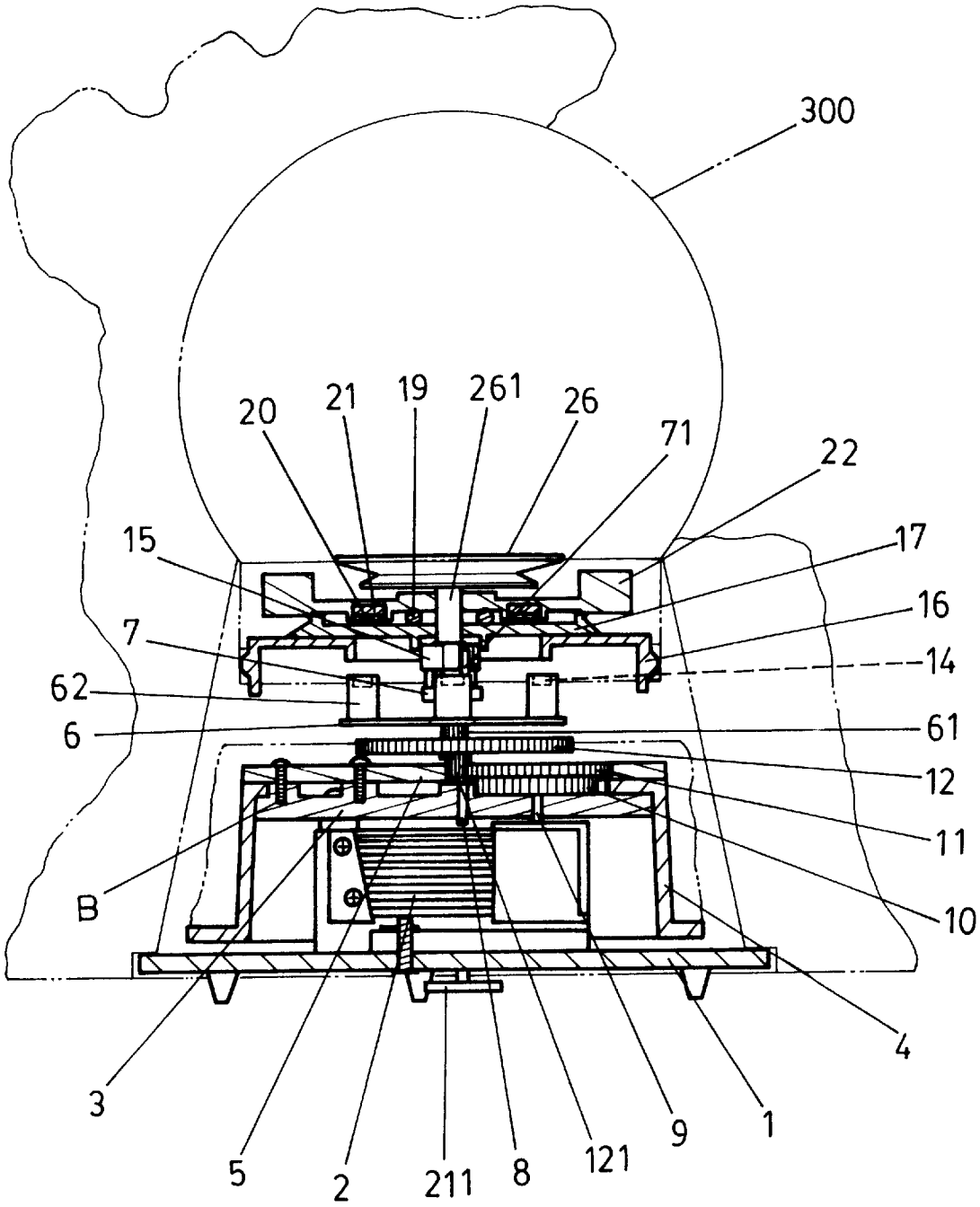
FIG. 5 is a cross-sectional drawing of the present invention.

Referring to FIG. 3, the lower rotary mechanism (100) comprises of a bottom plate (1), a music bell (2), a supporting frame (3), a gear ring tray (4), a plate (5), a magnet wheel (6), a transmission claw (7), an intermediate shaft (8), an inserting pin (9), an inner circumferential transmission gear (10), transmission gears (11, 12), a gear fastening shaft (13) and three magnets (14); the music bell (2) is fixed onto the bottom plate (1) by means of a screw (A); the supporting frame (3) is tightly locked unto the music bell (2) by means of another screw (B), while the plate (5) is tightly fastened unto the supporting frame (3) by means of yet another screw (C); the bottom end of the said music bell (2) is engaged with a spiral power spring (211), as shown in FIG. 5; winding the spiral power spring (211) drives a central shaft (212) at the top end of the music bell (2) to rotate and sent out music; the intermediate shaft (8) is bolted unto a central shaft (212); the intermediate shaft (8) extends through a central hole (31) of the supporting frame (3), a central hole (51) of the plate (5) and the magnet wheel (6) to join with the center of the transmission claw (7) at the top end; a gear (61) at the lower aspect of the magnet wheel (6) meshes with a big transmission gear (12); the big transmission gear (12) has a gear fastening shaft (13) and is fixedly bolted and coaxial with a small gear (121); the said small gear (121) meshes with another transmission gear (11); by means of an insert pin (9), the transmission gear (11) is bolted and coaxial with the filler circumferential transmission gear (10) at the lower aspect thereof; the inner circumferential transmission gear (10) meshes with a gear ring (41) on the inner rim of the gear tray (4); therefore, winding the spiral lower spring (211) synchronously drives the gear tray (4), the magnet wheel (6) and the transmission claw (7) at the top end to rotate; the magnet wheel (6) is in a triangular shape with magnet slots (62) on the three sides for bearing magnets (14); the top end of the transmission claw (7) has four claws (71). Referring to FIG. 4, the upper rotary mechanism (200) comprises of a transmission claw (15), a crystal ball plug (16), an inner supporting seat (17), a round bead seat (18), a round bead (19), three magnet covers (20), three magnets (21), a magnet gear (22), a washer (23), a sealing ring seat (24), a sealing ring (25) and a rotary tray (26); the transmission claw (15) with a cross bottom end is held by four claws (71) of the transmission claw (7) at the top end of the lower rotary mechanism (100); a fastening pin (261) at the bottom end of the rotary tray (26) on the upper layer penetrates through the sealing ring (25), the sealing ring seat (24), the washer (23), the magnet gear (22), the round bead seat (18), the supporting seat (17) of the inner rotary gear and the crystal ball plug (16) and is fixedly bolted inside the central hole of the transmission claw (15); the transmission claw (15) is capable of driving the rotary tray (26) to rotate; the rubber-made crystal ball plug (16) is affixed and joined with the glass-made crystal ball (300) for forming a waterproof mechanism to facilitate filling the water inside the crystal ball (300); the rim of the supporting seat (17) of the inner rotary gear is provided for receiving the round bead seat (18); four round holes (181) on the round bead seat (18) are provided for placing the round beads (19) to form sliding shaft bearing; three magnets (21) are respectively disposed into three magnet slots (221) at the bottom end of the magnet gear (22) and sealed by means of magnet covers (20); then the magnet gear (22) is covered onto the supporting seat (17); through the disposition of the sliding shaft bearing, the magnet gear (22) rotates easily and smoothly; since the magnets (21) inside the magnet gear (22) repulse the magnets (14) on the magnet wheel (6), when the magnet wheel (6) rotates, the principle of magnetic repulsion drives the magnet gear (22) to rotate unstably; therefore, the magnet gear (22) inside the crystal ball (300) makes the water flow rotate and snowflakes (500) float.

In summation of the abovementioned present invention of a music bell striking snowflakes in a crystal ball, when the spiral power spring (221) is wound tightly to make the music bell (2) generate dynamic force to rotate, it synchronously drives the gear tray (4) decorated as a turning wheel at the bottom end and the rotary tray (26) with dolls standing at the top end to rotate in different directions; at the same time, it also drives snowflakes (500) in side the crystal ball (300) to float so as to form a beautiful, rotary and dynamic scenery inside the crystal ball (300).

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A music bell striking snowflakes inside a crystal ball comprising:

a lower rotary mechanism, an upper rotary mechanism, and a crystal ball containing a doll and water, with a plurality of snowflakes in said water; wherein said lower rotary mechanism comprises a bottom plate, a music bell on said bottom plate, a transmission gear supporting frame, a gear tray, a plate, an intermediate shaft for engaging a central shaft at a bottom end of said music bell, an inserting pin for connecting a plurality of transmission gears; and wherein a magnet wheel is disposed on an upper surface of said plate, a magnet slot of said magnet wheel containing at least one magnet, a transmission claw connected to said magnet wheel engages said upper rotary mechanism, a fastening pin connected to a rotary tray of said upper rotary mechanism passes through a sealing ring, a sealing ring seat, a washer, a magnet gear with at least one magnet affixed thereto, a round bead seat, a supporting seat and a crystal ball plug and is fixedly bolted inside a central hole of said transmission claw, and round holes on a round bead seat are provided for receiving round beads to form a sliding shaft bearing; such that when said rotary tray rotates, said transmission claw causes said crystal ball to rotate, and said magnet of said magnet gear repulse said magnet of said magnet wheel, magnetic repulsion causes said magnet gear to rotate, thereby causing said magnet gear to create water flow and move said snowflakes.

* * * * *